US005217510A

United States Patent [19]

Logan et al.

[11] Patent Number: 5,217,510

[45] Date of Patent: Jun. 8, 1993

[54] APPARATUS FOR PREVENTING PARTICLE DEPOSITION FROM PROCESS STREAMS ON OPTICAL ACCESS WINDOWS

[75] Inventors: Ronald G. Logan, Fredericksburg, Va.; Ulrich Grimm, Morgantown, W. Va.

[73] Assignee: The United States of America as represented by The United States Department of Energy, Washington, D.C.

[21] Appl. No.: 779,473

[22] Filed: Oct. 18, 1991

[51] Int. Cl.[5] ..... B03C 3/40

[52] U.S. Cl. ..... 55/101; 55/139; 55/152; 55/154; 55/385.1

[58] Field of Search ..... 55/101, 137-141, 55/150, 152, 385.1, 154, 156; 422/55; 73/323-325

[56] References Cited

U.S. PATENT DOCUMENTS

| | | | |
|---|---|---|---|
| 3,129,157 | 4/1964 | Loeckenhoff | 55/152 X |
| 3,320,151 | 5/1967 | Tepe et al. | 55/152 X |
| 3,421,050 | 1/1969 | Topper et al. | 55/101 X |
| 3,558,286 | 1/1971 | Gourdine | 55/152 X |
| 3,562,509 | 2/1971 | Kahl, Jr. | 55/101 X |
| 3,606,531 | 9/1971 | Gourdine | 55/152 X |
| 3,985,524 | 10/1976 | Masuda | 55/137 X |

*Primary Examiner*—Richard L. Chiesa

*Attorney, Agent, or Firm*—David E. Breeden; Stephen D. Hamel; William R. Moser

[57] ABSTRACT

An electrostatic precipitator is disposed inside and around the periphery of the window of a viewing port communicating with a housing through which a particle-laden gas stream is being passed. The precipitator includes a pair of electrodes around the periphery of the window, spaced apart and connected to a unidirectional voltage source. Application of high voltage from the source to the electrodes causes air molecules in the gas stream to become ionized, attaching to solid particles and causing them to be deposited on a collector electrode. This prevents the particles from being deposited on the window and keeps the window clean for viewing and making optical measurements.

13 Claims, 3 Drawing Sheets

APPARATUS FOR PREVENTING PARTICLE DEPOSITION FROM PROCESS STREAMS ON OPTICAL ACCESS WINDOWS

ORIGIN OF THE INVENTION

The United States Government has rights to this invention pursuant to the employer-employee relationship of the United States Department of Energy and the inventors.

FIELD OF THE INVENTION

This invention relates to apparatus and methods for preventing contamination of optical windows used for in-situ measurements of process streams.

BACKGROUND OF THE INVENTION

In-situ measurements of species in process streams are preferred over extractive methods of analysis because of the uncertainty that extracted samples remain representative of the process streams once they are removed and because of the extended time required for laboratory analyses. In-situ optical methods of analysis require the installation of windows on a process stream pipe, duct, or other housing, through which a light can enter and/or exit the process environment. This enables spectroscopic determinations of atomic or molecular species concentrations or measurements of physical characteristics of process streams such as temperatures, velocities, or particulates.

An inherent problem with the use of optical windows in making such measurements is the tendency of solid particles to become deposited on the interior surface of the windows. Deposits on the windows may arise from sources such as dust, process particles, or condensible vapors carried in the process stream. A layer of particles builds up on optical windows, attenuating light beams and interfering with optical measurements. A solution to this problem is especially needed for prevention of window contamination in apparatus used for study of coal conversion processes, where high temperatures, pressures, and contamination levels are frequently encountered, and where a need exists for unobstructed access for extended time intervals. For such applications, the design used to minimize window contamination must avoid producing chemical and physical changes to the process stream in the region being monitored.

Various approaches have been taken to remove or compensate for particle deposition on optical windows of process stream equipment. The attenuation of light beams by particulate deposits has been compensated for to some degree by using as a reference a parallel light source which is not absorbed by the process stream constituents. Both the signal and reference beam will be attenuated to the same degree by the layer of particles on the window. Thus, the degree of attenuation due to particles on the window is known, and the signal beam intensity measurements can be adjusted accordingly. This technique is useful for thin layers of deposits; however, as deposition on the windows continues, optical measurements become impossible, and the windows have to be cleaned. Cleaning the windows usually requires shutting down the process. Thus, frequent cleaning of optical windows is inconvenient and, in many cases, impossible.

Clean gas jets impinging on the interior surface of windows have been used to reduce the rate of particle deposition. However, this technique is often ineffective. This technique has the further disadvantage that the gas jet used to purge the windows mixes with the process stream, changing its composition and temperature profiles. Relatively large volume flows of purge gas are required to substantially reduce the rate of particle deposition.

SUMMARY OF THE INVENTION

The present invention is directed to an electrostatic precipitator positioned inside the window of a gaseous process stream viewing port. Deposition of solid particles carried the process stream onto the window of the port is prevented by collection of the particles on a precipitator electrode. The precipitator includes a discharge electrode and a collecting electrode operably connected to a source of unidirectional voltage, the electrodes being disposed around the periphery of the viewing port so as to avoid interference with optical access. Viewing ports for which the invention may be used typically are located at the ends of tubular housing perpendicular to a pipe or duct in which the process stream is carried, with transparent windows disposed across ends of the housing.

In operation, a strong electrical field is developed by initiating a voltage differential between the electrodes. Air molecules are ionized at some critical voltage, causing a flow of negative and positive gas ions to the collecting and discharge electrodes, respectively. The air ions become attached to the particles, giving them a charge and also causing them to migrate toward the electrodes. In this way, particles are removed from the gas stream and are prevented from depositing on the window. The gas adjacent to the windows is stationary, and the particles move through the gas by electrophoresis. Thus, the particles have low velocity, facilitating their removal using this device and method.

Devices embodying the invention prevent particle deposition on optical windows used on process streams or reactor apparatus to a much greater degree and more efficiently than any other method available. A further advantage is that the device does not require the use of gas jets which would mix with the process stream and change its composition or temperature profiles. This facilitates making optical measurements and keeps sight windows clean so as to allow undiminished viewing of the process being observed.

It is, therefore, an object of this invention to provide apparatus for preventing deposition of solid particles on optical windows used for viewing process streams.

Another object is to provide such apparatus that keeps optical windows clean without requiring use of purge gases.

Other objects and advantages of the invention may be seen by reference to the following detailed description and the appended claims.

DESCRIPTION OF THE PREFERRED EMBODIMENT

Figure 1:
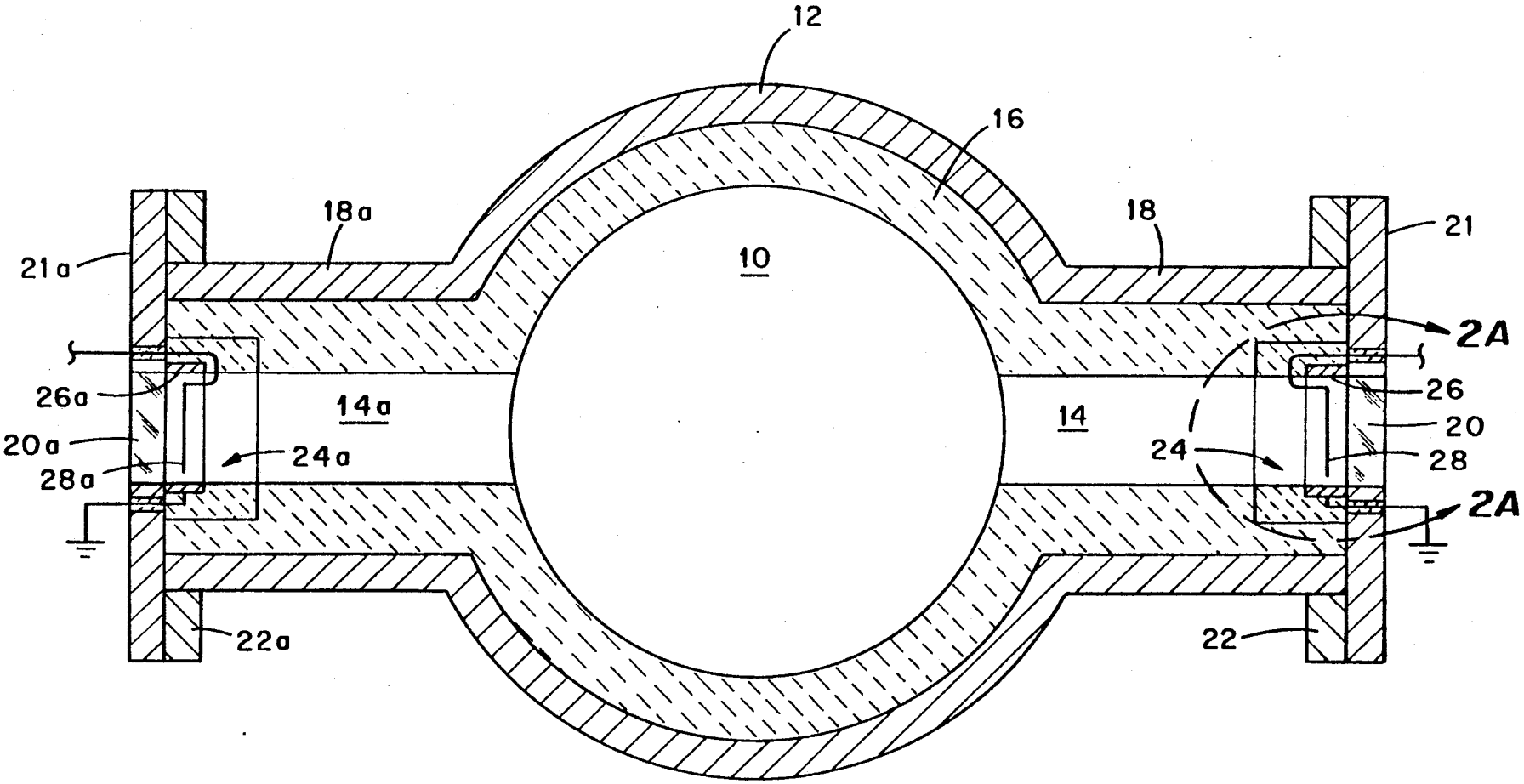
FIG. 1 is a view taken in section showing a precipitator embodying the invention installed in a pair of viewing ports of a process stream pipe.

Referring to FIG. 1 of the drawings, there is shown a tubular reactor containment chamber 10 adapted to have a particle-containing or particle-producing process stream moved longitudinally therethrough. The chamber is defined by a metal pipe 12 and refractory liner 16 on the inside of the pipe. Radially extending viewing ports 14, 14*a* are provided opposite from one another on the pipe wall, the ports being contained within refractory-lined tubular housing 18, 18*a* joined to the pipe. The ports are in axial alignment with one another to enable light to be passed through the chamber from one side, with observations or measurements being made at the opposite side.

Transparent windows 20,20*a* are disposed across the housing ends in a sealed assembly that prevents escape of process stream gas. The windows are supported in circular plates 21, 21*a*, which in turn are secured to flanges 22, 22*a*. The windows are made of a material selected to provide transparency at the spectral range of the investigations, and they are preferably sized to accommodate the F number of the optical apparatus involved.

Figure 2A:
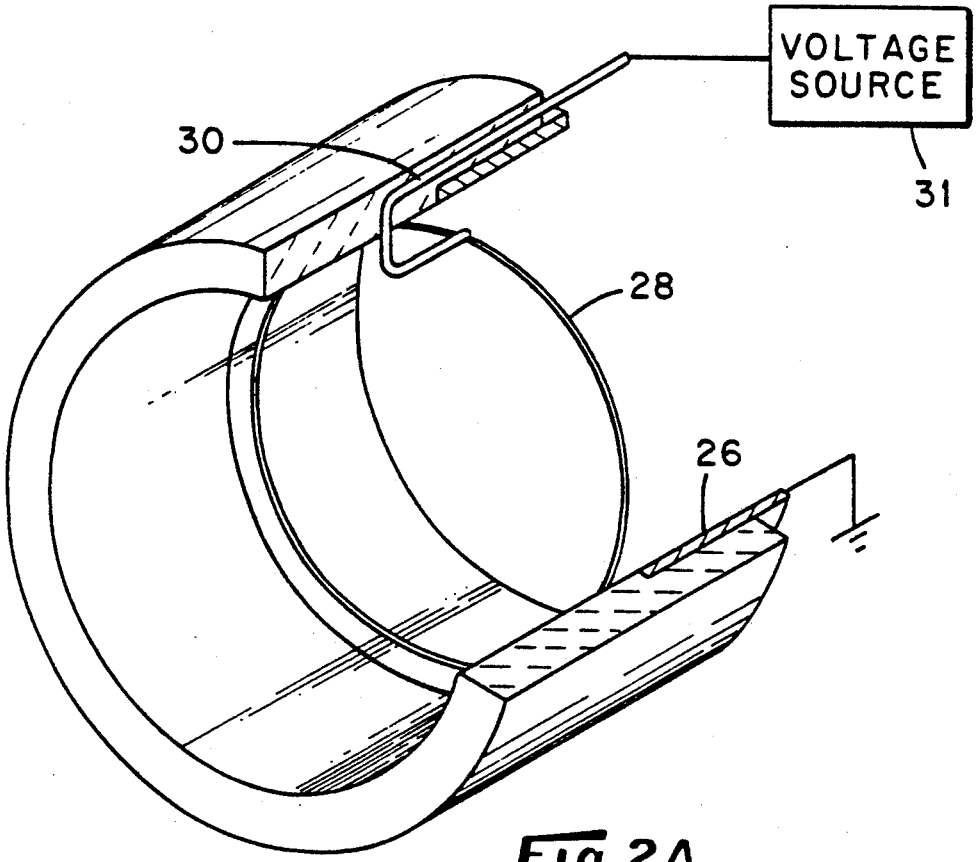
FIG. 2A is a pictorial view, partly broken away, of the area shown by line 2A—2A of FIG. 1.
Figure 2B:
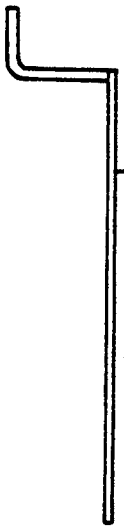
FIG. 2B is a side view showing one embodiment of an inner electrode ring.
Figure 2C:
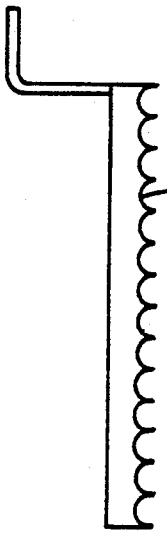
FIG. 2C is a side view showing a toothed ribbon electrode embodiment.

Precipitators 24 and 24*a* of the present invention have a pair of electrodes 26, 28 and 26*a*, 28*a* which may be made of any conductive metal compatible with the process temperatures and atmospheres involved. Outer electrodes 26, 26*a* are provided in the form of conductive metal bands embedded in the inner surface of the refractory liner and are connected to ground. Inner electrodes 28, 28*a* may comprise conductive metal wire rings as shown in FIGS. 2A and 2B supported by stiff conductive wires 30 that extend outwardly through apertures in the refractory liner, the electrodes being spaced apart from one another by the refractory material. Insulated high-pressure feedthroughs are used for passage of the electrode wires through the end plates to avoid leakage of the process stream gas. The inner electrodes are electrically connected to a current-limiting high volta source 31 selected to provide a potential sufficiently high maintain a steady corona discharge, but below the voltage which would produce an unstable condition bordering on flareover. The maximizes ionization of gas molecules in the process gas, initiating particle migration. The electrodes may be made of electrically conductive material suitable for use at the temperatures and atmospheres presented in a specific process stream. Either of the electrodes may be given a positive or negative charge, with the other electrode being given the opposite charge.

Figure 3:
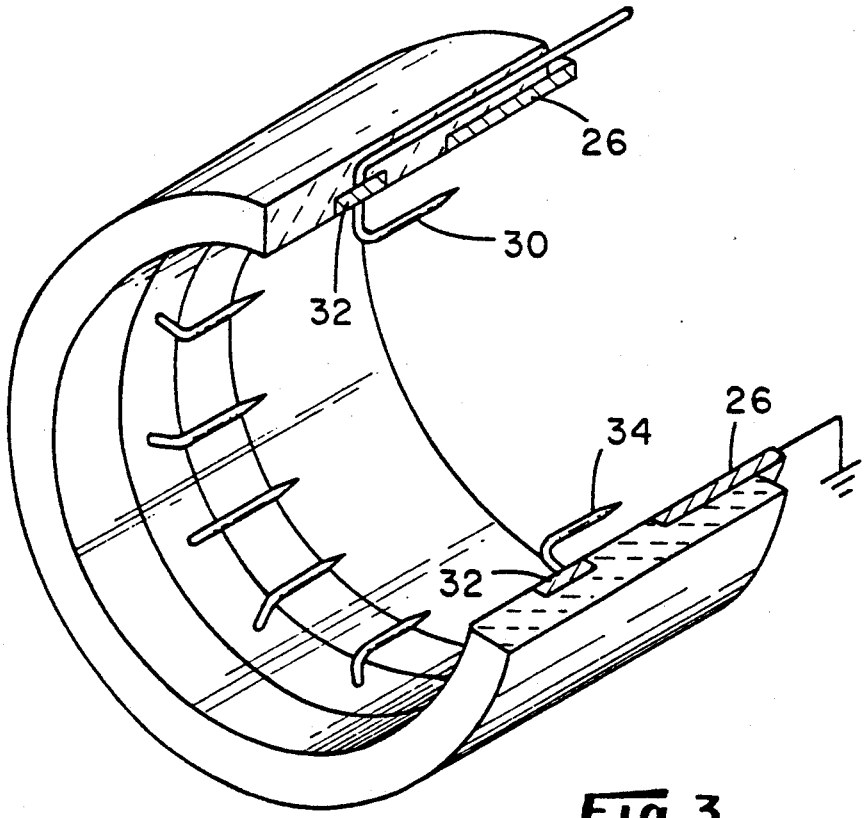
FIG. 3 is a pictorial view, partly broken away, showing an alternate embodiment of the invention wherein the discharge electrode has a plurality of radially extending fingers.

FIG. 3 shows an embodiment in which electrode 32 is a met band embedded in the refractory liner in axial alignment with electrode 26. Conducting fingers 30 connected to electrode 32 have an L-shaped structure, extending radially inward for a short distance and then axially away from the window, the fingers being disposed near the periphery of the window so as not to interfere with viewing. This structure provides for enhanced ionization of gas molecules in the viewing port.

The invention is described above with reference to its application to apparatus having a pair of viewing ports disposed on opposite sides of a reaction chamber, which enables light to be passed through both ports for making and recording observations. It is to be understood that the precipitator of this invention may also be used for single viewing ports. Other equipment such as lenses for focusing light into the desired viewing area may also be used in combination with the apparatus shown.

We claim:

1. Apparatus for preventing deposition of particles from a contained particle-laden gas stream onto a window of a viewing port exposed to said stream comprising:

a first tubular metal housing having an inner end and an outer end, the inner end being connected to a process stream containment pipe and the outer end having said window disposed across the housing in sealed relation thereto;

a pair of electrically conductive electrodes disposed inside said window around its periphery, electrically isolated and spaced apart from one another, and arranged to be exposed to a portion of said gas stream; and a unidirectional voltage source coupled to at least one of said electrodes for creating a positive charge on one electrode and a negative charge on the other;

whereby gas molecules adjacent to said window may be ionized, causing attraction of particles to the ionized molecules and deposition thereof onto said electrode.

2. Apparatus as defined in claim 1 wherein said electrodes comprise metal rings.

3. Apparatus as defined in claim 2 including a tubular refractory liner disposed inside of and in contact with said housing.

4. Apparatus as defined in claim 3 wherein both of said electrodes are metal bands embedded in the surface of said liner.

5. Apparatus as defined in claim 3 wherein a first one of said electrodes is embedded in the surface of said liner, and a second one thereof is supported by a stiff wire secured in an aperture within said liner.

6. Apparatus as defined in claim 5 wherein said second electrode includes a plurality of L-shaped fingers extending radially inward from said ring and having a bent-over portion extending axially in the direction of said containment pipe.

7. Apparatus as defined in claim 1 wherein said voltage source is a current limiting voltage source.

8. Apparatus as defined in claim 1 wherein said window is supported by a metal plate secured to said second end.

9. Apparatus as defined in claim 1 including a second tubular metal housing connected to said pipe opposite to said first housing in axial alignment therewith and defining a second viewing port.

10. Apparatus for viewing a particle-carrying gas stream located in a chamber isolated from ambient air and having a longitudinal axis comprising:

a pair of tubular metal housings each having an inner end secured to said chamber and an outer end spaced apart from the chamber, said housings being disposed perpendicular to said axis on opposite sides of the chamber and in axial alignment with one another;

a pair of windows, one of each disposed across one of said outer ends and sealably connected thereto, said windows defining a line of sight passing through and emerging from said chamber;

two pairs of electrically conductive electrodes, one each of said electrode pairs disposed inside of a said window around the periphery of the window, the electrodes of each pair electrically being isolated from one another and arranged to be exposed to a portion of said gas; and a unidirectional voltage source coupled to at least one of said electrodes of each pair for creating a positive charge on one electrode and a negative charge on the other;

whereby gas molecules adjacent to said windows may be ionized, causing attraction of particles and deposition thereof onto a said electrode, and preventing deposition of particles on said windows.

11. Apparatus as defined in claim 10 wherein said electrode comprise metal rings.

12. Apparatus as defined in claim 11 including a tubular refractory liner disposed inside of each of said housings.

13. Apparatus as defined in claim 12 wherein a first one of each of said electrode pairs is embedded in a said liner, and a second one thereof is supported by a stiff wire secured in an aperture within a said liner.

* * * * *